US009255376B2

(12) United States Patent
Biserna

(10) Patent No.: US 9,255,376 B2
(45) Date of Patent: Feb. 9, 2016

(54) MODULAR SYSTEM OF MUTLI-PURPOSE RODS FOR DRILLING SOIL

(75) Inventor: Ezio Biserna, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 166 days.

(21) Appl. No.: 13/322,401

(22) PCT Filed: May 7, 2010

(86) PCT No.: PCT/EP2010/002806

§ 371 (c)(1),
(2), (4) Date: Nov. 23, 2011

(87) PCT Pub. No.: WO2010/136117

PCT Pub. Date: Dec. 2, 2010

(65) Prior Publication Data

US 2012/0067650 A1 Mar. 22, 2012

(30) Foreign Application Priority Data

May 26, 2009 (IT) ..... TO09A0394

(51) Int. Cl.

| | |
|---|---|
| ***F16L 19/00*** | (2006.01) |
| ***E02F 3/06*** | (2006.01) |
| ***E02D 3/12*** | (2006.01) |
| ***E02D 5/38*** | (2006.01) |
| ***E02D 5/52*** | (2006.01) |
| ***E02D 5/56*** | (2006.01) |

(Continued)

(52) U.S. Cl.

CPC . *E02F 3/06* (2013.01); *E02D 3/126* (2013.01); *E02D 5/38* (2013.01); *E02D 5/52* (2013.01); *E02D 5/56* (2013.01); *E02D 7/22* (2013.01); *E21B 17/046* (2013.01)

(58) Field of Classification Search

CPC ..... E02F 3/06; E02D 7/22; E02D 3/126; E02D 5/38; E02D 5/56; E02D 5/52; E21B 17/046

USPC ..... 285/120.1, 123.1, 123.3, 123.6, 123.9, 285/123.12, 123.13, 123.15, 124.1, 404

See application file for complete search history.

(56) References Cited

U.S. PATENT DOCUMENTS 2,610,028 A * 9/1952 Smith ..... 285/123.3 X
2,657,908 A * 11/1953 Failing (Continued)

FOREIGN PATENT DOCUMENTS

| | | |
|---|---|---|
| DE | 40 25 243 | 2/1992 |
| DE | 199 25 730 | 1/2001 |

(Continued)

OTHER PUBLICATIONS

International Search Report for International Application No. PCT/EP2010/002806 mailed Sep. 16, 2010.

*Primary Examiner* — Gregory Binda
(74) *Attorney, Agent, or Firm* — Merchant & Gould P.C.

(57) ABSTRACT

A modular system of multipurpose rods for drilling soil is constituted by rods (1) crossed by an internal passage (2) for the passage of concrete, of substantially cylindrical shape, that completely crosses the rod; each of the rods is provided at the endings with a male insert (5) and a female insert (6) respectively, adapted to be plugged in one to the other for permitting the assembly in batteries of any length. The inserts (5, 6) are provided with transmitters (11, 11*a*) for transmitting the rotation along the whole battery of rods (1) and arranged for fixing elements that reduce the internal passage (2).

12 Claims, 7 Drawing Sheets

(51) Int. Cl.
*E02D 7/22* (2006.01)
*E21B 17/046* (2006.01)

(56) References Cited

U.S. PATENT DOCUMENTS 5,713,423 A * 2/1998 Martin et al.
7,494,299 B1 2/2009 Whitsett
2002/0150430 A1 10/2002 Vickars et al.

FOREIGN PATENT DOCUMENTS

DE 199 38 577 2/2001
DE 103 27 732 1/2005
EP 0 228 138 7/1987
GB 2 286 029 8/1995
GB 2 440 939 2/2008

* cited by examiner

PRIOR ART

MODULAR SYSTEM OF MUTLI-PURPOSE RODS FOR DRILLING SOIL

This application is a National Stage Application of PCT/EP2010/002806, filed 7 May 2010, which claims benefit of Serial No. TO2009A000394, filed 26 May 2009 in Italy and which applications are incorporated herein by reference. To the extent appropriate, a claim of priority is made to each of the above disclosed applications.

BACKGROUND

The present invention takes its place in the field of mixing, consolidation and compaction technologies and concerns a modular system of multipurpose rods for drilling soils.

Various procedures are known for the consolidation of the soil through the formation of cylindrical columns of consolidated soil, based on the mixing of particles of the soil itself with binders, usually cemented mixtures.

A traditional procedure, through which a mainly mechanic mixing is carried out, uses the rotating movement of tools (see FIG. 1) able to dig and breaks up the soil through appendixes which radially extend to the axis of the tool itself. The soil so broken up is kneaded with a low-pressure (1-2 MPa) cemented mixture pumped through openings obtained on the tubular shaft right under the blades.

A known variant of the described procedure is to use higher pressures for the cemented mixtures. This technique, by using the combination of the mechanical action of the disintegrating gears of the tool and of the kinetic energy of the pressurized jets, differs for a substantial execution speed, with considerable economic advantages.

There are variants of these techniques which require a double line of cemented mixtures. In addition to the outputs on the shaft of the tool which interact with the disintegrating gears, there are others on the upper parts of the blades which treat a diameter of soil bigger than the one treated by the mechanical disintegrating gears. This increase of the treated diameter when it is not requested for all the depth, makes it necessary a double supply.

Another technology taken into consideration by the present invention is the one of compacting piles. From the European patent EP 0 228 138 it is known an excavation and compaction equipment for the construction of compacting piles. In this technology, during the excavation phase, the equipment undergoes a torque on the drill rod and a thrust on the excavation screw relatively elevated as the quantity of soil to be compacted during the excavation by the displacer element (FIG. 2) is of significant relevance and exerts also a strong resistance to the advancement of the tool in the soil itself. During the ascent, the excavation is filled by means of injection of concrete which passes through the rods and the tool itself.

The document U.S. Pat. No. 7,494,299 describes an equipment provided with screw tool to which a plurality of hollow, extended and substantially cylindrical shaped rods is applied.

The rods are provided with special endings adapted to vertically connect them. The inner of the rods is destined to be filled with concrete at the end of the anchoring procedures which provide that the rods themselves are disposable as reinforcing structural elements.

However, the internal passage of the rods is not cylindrical and reduces in correspondence with the endings provided with particular inserts for the assembly of the rods themselves.

Furthermore, the rods are designed for carrying inner elements adapted for realizing the rotation which reduce the internal passage but only in correspondence of said endings.

SUMMARY

The invention refers to a modular system of multipurpose rods for drilling soils which, opportunely assembled, permits the use of the described technologies of soil treatment without having to assemble one specific for each use.

BRIEF DESCRIPTION OF THE DRAWINGS

The equipment will be now described in some forms of embodiment by way of example according to the invention with reference to the attached drawings which show.

DETAILED DESCRIPTION

Figure 5:
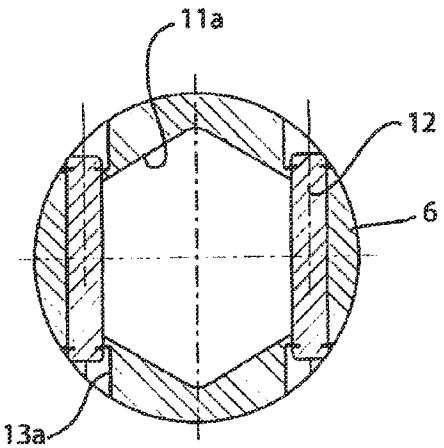
Fig.5 PRIOR ART
FIG. 5 shows the section according to the V-V trace of FIG. 4.
Figure 1:
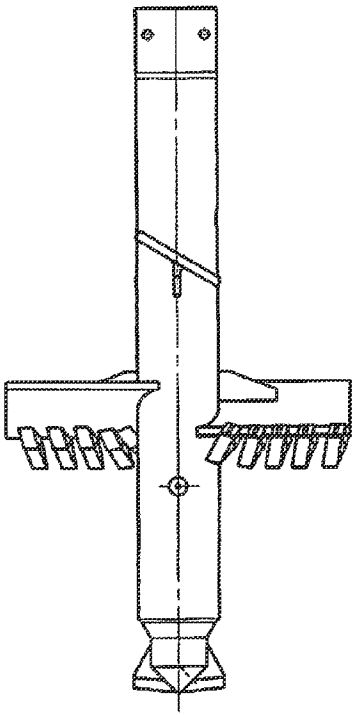
FIG. 1 shows a prior art rotating system.
Figure 2:
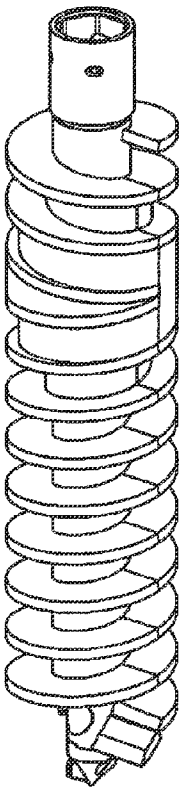
FIG. 2 shows a prior art compacting system.
Figure 3:
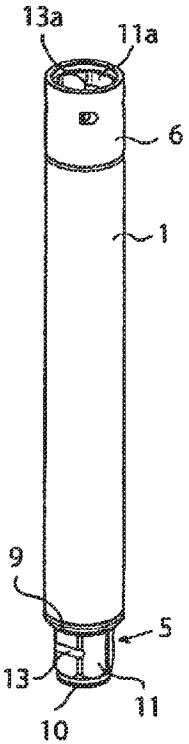
In FIG. 3 an axonometric projection of the part of the structural rod and common to different applicative technologies.
Figure 4:
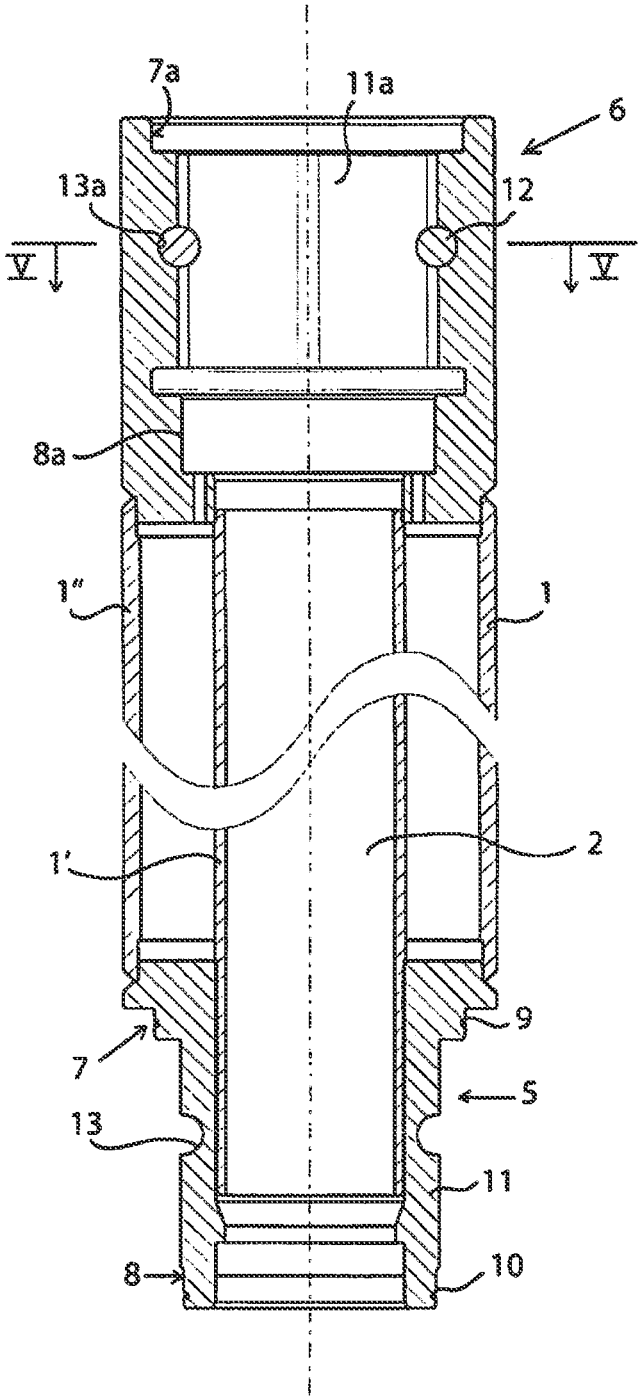
FIG. 4 shows the rod of FIG. 3 in longitudinal section.

Rod 1 according to the invention, visible in FIGS. 3, 4 and 5, is a modular rod provided with internal passage 2 created by an inner pipe 1' which guarantees the continuity of the internal passage, through a cylindrical shape constant for all the length, which permits an optimal runoff of the injected material and which contributes to the tensile structure by collaborating to the most external pipe 1" of rod 1, and provided at endings with a male insert 5 and a female insert 6 adapted to plug in one another in order to permit the assembly in batteries of desired lengths. The constant section of the internal passage avoids speed variations and material stagnations caused by the slowdowns in proximity of zones enlarged with respect to other narrower ones. The inserts are provided with polygonal zones 11 and 11*a* adapted to plug in one another (insertable the one in the other for a coupling length equal to at least one time the diameter) for permitting the torque transmission along the whole battery.

Furthermore, male insert 5 is provided with centering zones 7 and 8 compatible with respective zones 7*a* and 8*a* of female insert 6 and can be provided with respective gaskets 9 and 10.

The double centering guarantees the perfect alignment among adjacent elements of rods, necessary for permitting the correct functioning of the gaskets subject to pressure. A unique coupling could anyhow work but it would be much more axially extended and would have therefore a higher realization cost and would require a higher difficulty of insertion during the assembly.

Gasket 10 on the end avoids the leakage of the compacting mixture and at the same time prevents external agents from penetrating as far as internal passage 2. Gasket 9 has the function of protecting polygonal coupling 11 and 11*a* from the inlet of external agents (water, soil, mixing, and so on) which could make the disassembly of the rods difficult.

In inserts 5 and 6 there are spaces 13 and 13*a* for the assembly of pins 12 for holding the rods among them. In FIG. 5 it may be noticed that pins 12 are assembled with an axis mainly transversal with respect to the longitudinal direction of the rod and does not encumber further than the external diameter of the rods allowing the possibility of externally guiding the rod, during the excavation steps, without encountering discontinuities.

Figure 6:
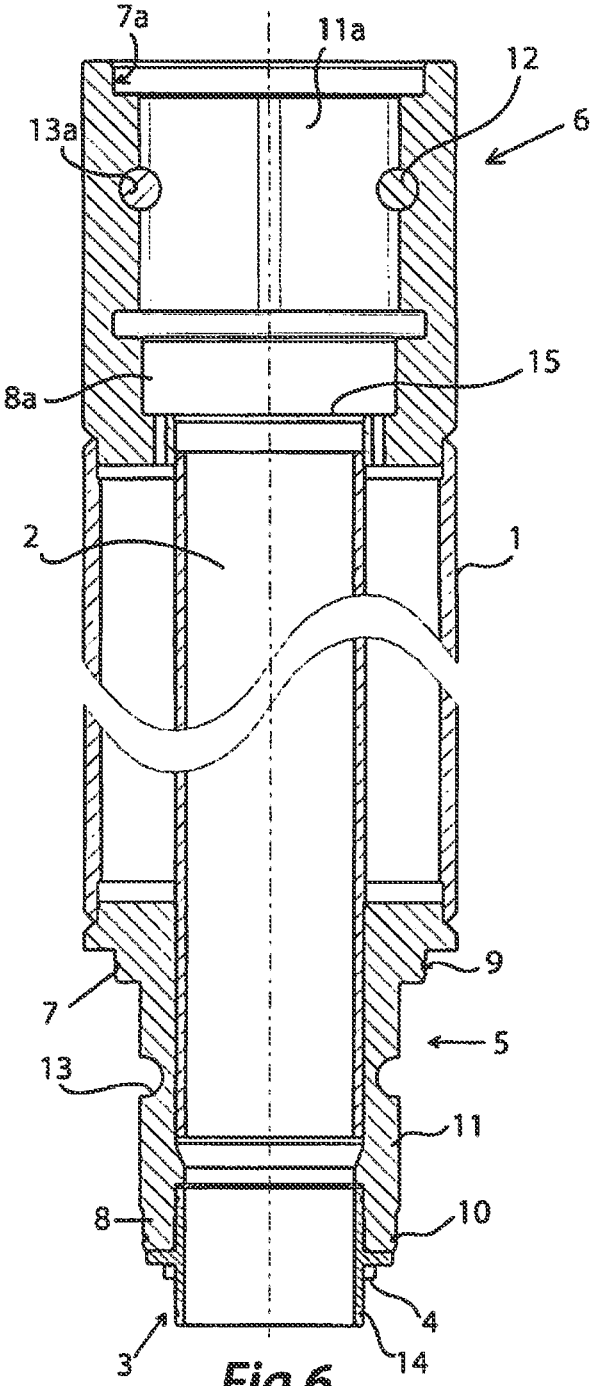
FIGS. 6, 7 and 8 shows the rod of the preceding figures in three different types of embodiments.

FIG. 6 shows the section of a rod according to the invention, wherein internal passage 2 is about 4"-6", preferably 5", adapted for the use for compacted piles, and with a seal collar 3 mounted on male insert 5 through a prearrangement that advantageously uses screws 4 for fixing. In order to avoid the leakage of the concrete during the injection, a gasket 14, mounted on seal collar 3, strikes in a zone 15 of female insert 6.

Figure 7:
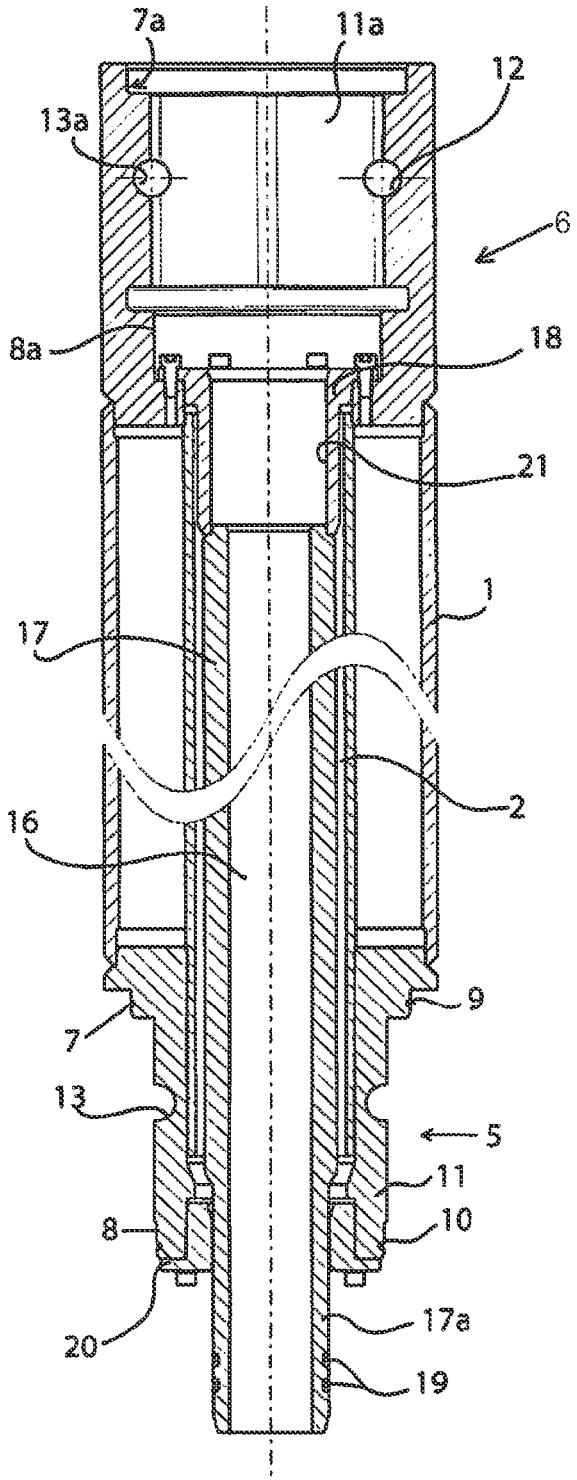

FIG. 7 shows a section of the rod assembled with the insertion of a pipe 17 which creates in its inner side a passage 16 of about 50-75 mm, preferably 2"¾ (about 70 mm), suitable for the realization of cylindrical columns of compacted ground. On female insert 6 of rod 1, described in FIG. 4, is screwed pipe 17 for the passage of the cemented mixture with flange terminal 18; on the opposite side, upon male insert 5, a flange 20 guarantees the centering between pipe 17 and rod 1, using the same prearrangements described for seal collar 3.

In segment 17*a* of pipe 17 which exceeds male insert 5 are obtained seats for gaskets 19 which, striking on zone 21 of pipe 17 on the side of female insert 6, can bear pressures up to 500 bar. Higher pressures require structural precautions and opportune choices of the most appropriate set of gaskets, with consequent cost increases.

Figure 8:
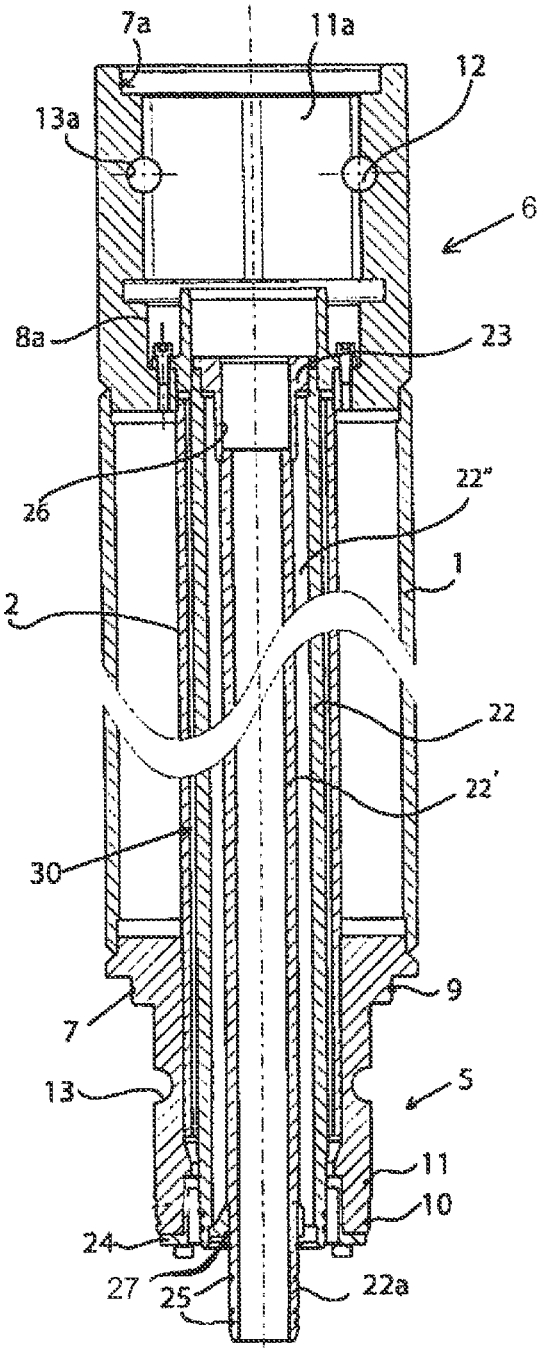

In FIG. 8 there is a section of rod 1 assembled for a double passage of fluids. On the rod described in FIG. 4 is screwed into female insert 6 an element 30 constituted by two concentric pipes 22 and 22' for providing an annular passage 22" of the cemented mixtures, and provided with flange terminal 23 which fixes in the same prearrangement present on female insert 6 of rod 1 upon which, as previously described, it has been fixed flange 18; on the opposite side, on male insert 5, a flange 24 guarantees the centering between pipe 22 and rod 1 and it is also fixed using the prearrangements present on male insert 5, upon which as previously described are fixed seal collar 3 and flange 24.

In segment 22*a* of pipe 22' which exceeds centering flange 24 of male insert 5, are obtained seats for gaskets 25 which, finding strike upon zone 26 on the side of female insert 6, can bear pressures up to 500 bar.

Figure 9:
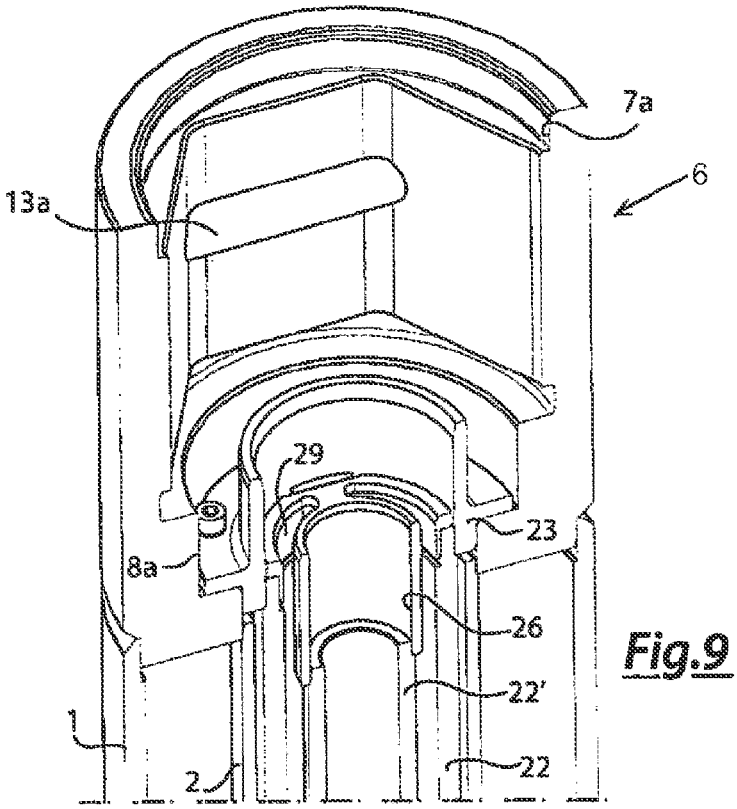
FIGS. 9 and 10 shows partial perspective views in longitudinal section of the two portions of pipe endings according to the invention in the form of embodiment shown in FIG. 8.

In FIG. 9 there is the upper part of the embodiment of FIG. 8 so that it is possible to detect that flange 23 is provided with passages 29 for not completely obstructing annular passage 22" between pipes 22 and 22' and leaving suitable structural strength to the part.

Figure 10:
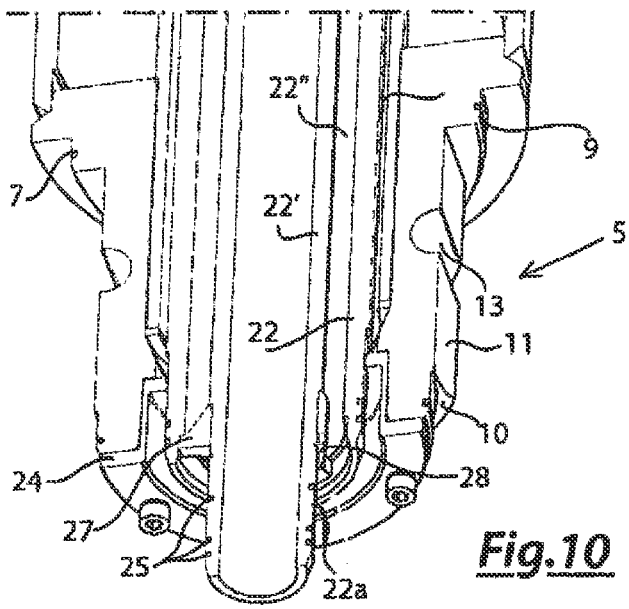

FIG. 10 shows the zone of the male insert embodiment of FIG. 8 where protruding ending 22*a* of the pipe for the central passage is kept at the center of the pipe for annular passage 22" by a support 27 which leaves free some perimeter areas.

An elastic ring 28 holds centering support 27 and prevents its extraction by means of the stair obtained through the processing on segment 22*a* for the external centering of central pipe 22'.

It is finally clear that to the device up to here described can be applied some variants, changes or adaptations without exiting from the protection field of the claims of the present invention. For example, it is clear that the preferred connection system among the different reference flanges described (3, 18, 20, 24, 23, 27) through screws, can be replaced by alternative systems (such as for instance threadings, interference mountings, bayonet coupling, glueings) which can be advantageously used as they are equivalent. The solution with screw coupling permits a maneuvering easiness during the mounting steps of the different variants and guarantees with opportune reference shoulders a perfect centering between the coupled parts which render it preferable with respect to the other systems previously described.

By means of the solution proposed by the invention, the use of a unique external structural rod opportunely arranged for the various kinds of ground treatment technologies brings to a reduction of the storage with consequent cost reduction.

Furthermore, the assemblies for the various technologies are of easy and rapid mounting and removal encouraging the flexibility and the maintenance.

Finally, given that the single or two-passages inner rods are wear components, in the solution according to the invention they are easily replaceable, and therefore the recovery in the construction site is immediate, using again the same structural body.

Rod 1 common to different technologies is the structural part for which the inner elements can be advantageously sized only for bearing the inner pressures and for being adequately fixed and centered with respect to rod 1.

The invention claimed is:

1. A multipurpose rod adapted for assembly with other multipurpose rods to form a modular system for drilling soil;

said rod defining an internal passage extending along an entire length of said rod for passage of at least a cement mixture under pressure, said rod comprising:

a substantially cylindrical shape and a substantially constant external diameter;

a male insert and a female insert at opposite ends of said rod, adapted to be plugged in one to the other for permitting assembly in a battery of rods of any length;

an external structural pipe to which said male insert and the female insert are fixed;

an inner pipe fixed to said male insert and said female insert, said inner pipe contributes to tensile structure of the rod with the external pipe; said inner pipe defining at least part of said internal passage having a cylindrical shape and constant section at least between said male insert and said female insert along the length of said rod;

both said external pipe and said inner pipe have a constant cylindrical shape;

the inserts of the ends of said rod being provided with means adapted for transmitting rotation along the whole battery;

said rod further comprising prearrangements for a connection system configured for removably connecting a further pipe in order to reduce the internal passage of said inner pipe of said rod;

wherein said prearrangements for a connection system are placed both in the male insert and in the female insert, said prearrangements being configured to connect reference flanges in order to ensure centering between the further pipe and the inner pipe of the rod;

wherein said inserts define spaces adapted for mounting pins to hold the rod to the other rods to create the battery; and wherein the pins extend no further than an external diameter of the rods and have an axis substantially transverse to a longitudinal direction of the rod.

2. The multipurpose rod according to claim 1 wherein the means adapted for transmitting the rotation along the whole battery of rods are polygonal zones configured so that the rods can be plugged in one another.

3. The multipurpose rod according to claim 1 wherein the internal passage of said rod measures approximately 4"-6".

4. The multipurpose rod according to claim 3 wherein a seal collar is firmly fixed upon the male insert and wherein at least a gasket, mounted upon the seal collar, strikes the female insert in a zone.

5. The multipurpose rod according to claim 1, wherein a segment of the further pipe exceeds the male insert and in the segment are seats for gaskets that strike upon the zone of the pipe on the side of the female insert.

6. The multipurpose rod according to claim 1, wherein the prearrangements of the female insert are configured for removably connecting a pipe element; said pipe element comprising two concentric pipes, adapted for creating an annular passage of the cement mixtures under pressure.

7. The multipurpose rod according to claim 6 wherein said prearrangements are a screwed connection system configured to screw said pipe element upon the female insert of the rod by a flange terminal, wherein on the opposed side, upon the male insert, a flange guarantees centering between the pipe element and the rod.

8. The multipurpose rod according to claim 6 wherein in a segment of the pipe that extends from the centering flange to the male insert, are seats for gaskets that strike upon on the opposite side of the female insert.

9. The multipurpose rod according to claim 8 wherein an elastic ring holds the centering support and prevents extraction of the centering support by a stair obtained through the processing on the segment for external centering of the central pipe.

10. The multipurpose rod according to claim 6 wherein the flange provided in correspondence corresponding to the female insert is provided with passages for not completely obstructing the annular passage between the pipes and for leaving suitable structural strength to the flange.

11. The multipurpose rod according to claim 1, wherein said prearrangements for a connection system placed in the female insert comprise a threaded portion in which the further pipe is screwed.

12. The multipurpose rod according to claim 1, wherein said further pipe reduces the internal passage of each rod by approximately 2"-3" for the passage of the cement mixture under high pressure.

* * * * *